US005737241A

United States Patent [19]

Accolla et al.

[11] Patent Number: 5,737,241

[45] Date of Patent: Apr. 7, 1998

[54] USER MANAGEMENT INTERFACE FOR EAS SYSTEM

[75] Inventors: William R. Accolla, Loxahatchee; Harry Watkins, Boca Raton; Mark Krom, Ft. Lauderdale, all of Fla.

[73] Assignee: Sensormatic Electronics Corporation, Boca Raton, Fla.

[21] Appl. No.: 556,763

[22] Filed: Nov. 2, 1995

[51] Int. Cl.[6] ..... G08B 13/00

[52] U.S. Cl. ..... 364/550; 340/551; 340/572

[58] Field of Search ..... 364/146, 188, 364/550; 340/547, 551, 572, 825.06, 825.54

[56] References Cited

U.S. PATENT DOCUMENTS

| | | | |
|---|---|---|---|
| 4,471,343 | 9/1984 | Lemelson | 340/571 |
| 4,859,991 | 8/1989 | Watkins et al. | 340/572 |
| 5,317,304 | 5/1994 | Choi | 340/571 |
| 5,353,011 | 10/1994 | Wheeler et al. | 340/572 |
| 5,495,229 | 2/1996 | Balch et al. | 340/551 |
| 5,627,516 | 5/1997 | Balch et al. | 340/572 |

*Primary Examiner*—James P. Trammell
*Assistant Examiner*—Edward Pipala
*Attorney, Agent, or Firm*—Robin, Blecker, Daley and Driscoll

[57] ABSTRACT

A user management interface for interaction, monitoring and control of an EAS system. A user accessible input is provided in the interface for actuation by a user. A generation assembly is responsive to the input and generates signals for interacting with the EAS system. A receiver at the interface receives signals from the EAS system and provides indications with respect thereto.

40 Claims, 10 Drawing Sheets

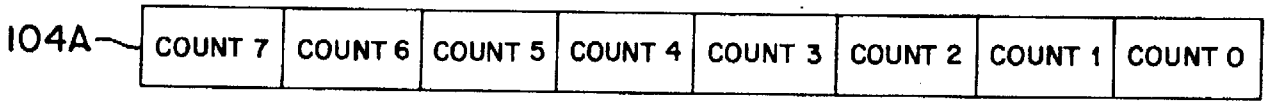
FIG. 7
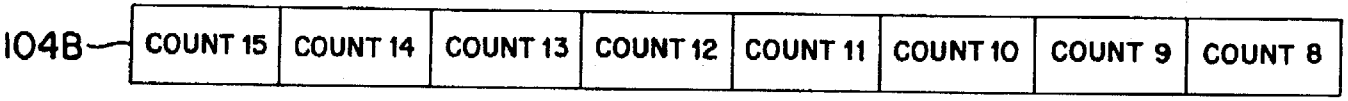
FIG. 8
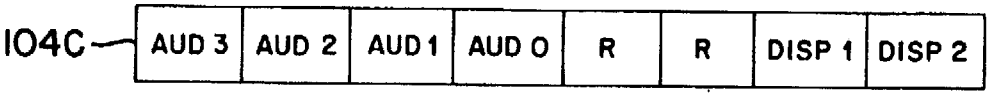
FIG. 9
| DISP 1 | DISP 0 | |
|---|---|---|
| 0 | 0 | PEOPLE COUNT |
| 0 | 1 | ALARM COUNT |
| 1 | 0 | DEACTIVATION COUNT |
| 1 | 1 | BYPASS COUNT |
FIG. 10

USER MANAGEMENT INTERFACE FOR EAS SYSTEM

BACKGROUND OF THE INVENTION

This invention relates to electronic article surveillance ("EAS") systems and, in particular, to apparatus for interfacing with such systems.

In recently developed EAS systems, a central station including a central processing unit is used to control operation of the system. The central station provides control signals for the transmitter and receiver assemblies of the system so that interrogation signals can be transmitted into an interrogation zone and signals can be received from the zone.

The central station also provides processing of the signals received by the receiver assembly and makes a determination as to whether any EAS tag signals are contained in the received signals. The central station develops an alarm condition when EAS tag signals are found to be present and causes an audible and/or visual alarm to be activated.

In the above EAS systems, access to the systems has been limited. Only installation and maintenance personnel of the manufacturers and/or sellers of the EAS systems have been provided with specialized equipment for gaining access to the central station for initializing and maintaining the system. Since the central station may be in an inaccessible location, this is often a difficult procedure even for the installation and maintenance personnel.

Moreover, the users of EAS systems have not been permitted access to the systems and have been provided with limited data with respect to operation of the systems. Usually, simple counters on the antenna assemblies have been provided to give an indication of the number of alarms which have occurred, but this is the extent of the information provided.

Recently, users of EAS systems have expressed the need to exercise some degree of control over the systems, both for maintenance and operational purposes. Additionally, users have looked to obtain added information or data about events occurring in the system so that adjustments can be made to enhance performance.

It is, therefore, an object of the present invention to provide a user management interface for permitting user access to an EAS system.

It is a further object of the present invention to provide a user management interface which permits a user to have a degree of control over operation of an EAS system.

It is a further object of the present invention to provide a user management interface which permits a user to access data regarding the status of an EAS system and the events occurring in the system.

SUMMARY OF THE INVENTION

In accordance with the principles of the present invention, the above and other objectives are realized in a user management interface which includes a user accessible input means for actuation by a user, generating means for generating signals for interacting with the EAS system in response to the user accessible actuation means, and means for receiving signals from the EAS system and providing indications associated with the received signals.

In the embodiment of the user management interface to be disclosed hereinafter, the user accessible input means and the generating means cooperate to generate signals for establishing various operating modes in which the EAS system and an EAS tag deactivation device can be or are selectively enabled and/or disabled and data regarding system events can be accessed. Signals corresponding to the accessed system event data and to the enabled/disabled status of the EAS system and deactivation device are received by the receiving means of the interface. The receiving means provides indications thereof by displaying the system event data, by displaying an indication of the type of event data being displayed and by displaying indications of the status of the EAS system and deactivation device.

The input means of the interface includes a rotatable key switch which provides security for the interface. The various positions of the key switch establish the various operating modes and cause the generating means to generate signals which identify the operating modes to the system and condition the system to interpret subsequent user inputs through a momentary switch of the user accessible input means.

In a first key switch position corresponding to a first operating mode in which the EAS system and deactivation device are enabled, activation of the momentary switch causes the generating means to generate a signal which results in the EAS system disabling itself for a preselected period of time. In second and third key switch positions corresponding to second and third operating modes in which the EAS system is enabled and the deactivation device is enabled and disabled, respectively, activation of the momentary switch results in the generating means generating event data request signals. Successive activation of the momentary switch results in different event data request signals being generated. Each event data request signal causes the EAS system to access the particularly requested event data and signals carrying the data are received by the receiving means of the interface and the data displayed along with an indication of the type of data.

The generating means is also adapted to generate a reset signal with the key switch in a given one of its positions. The EAS system responds to the reset signal by resetting to zero the event data currently being displayed.

In a further embodiment of the user management interface, the interface includes a microcontroller and an input keyboard and keypad.

DETAILED DESCRIPTION OF THE DRAWINGS

The above and other features and aspects of the present invention will become more apparent upon reading the following detailed description in conjunction with the accompanying drawings, in which:

FIGS. 4–9 illustrate the contents of various data messages being used in the EAS system of FIG. 1;

FIG. 10 illustrates a logic table used in the local station in the EAS system of FIG. 1;

DETAILED DESCRIPTION

Figure 1:
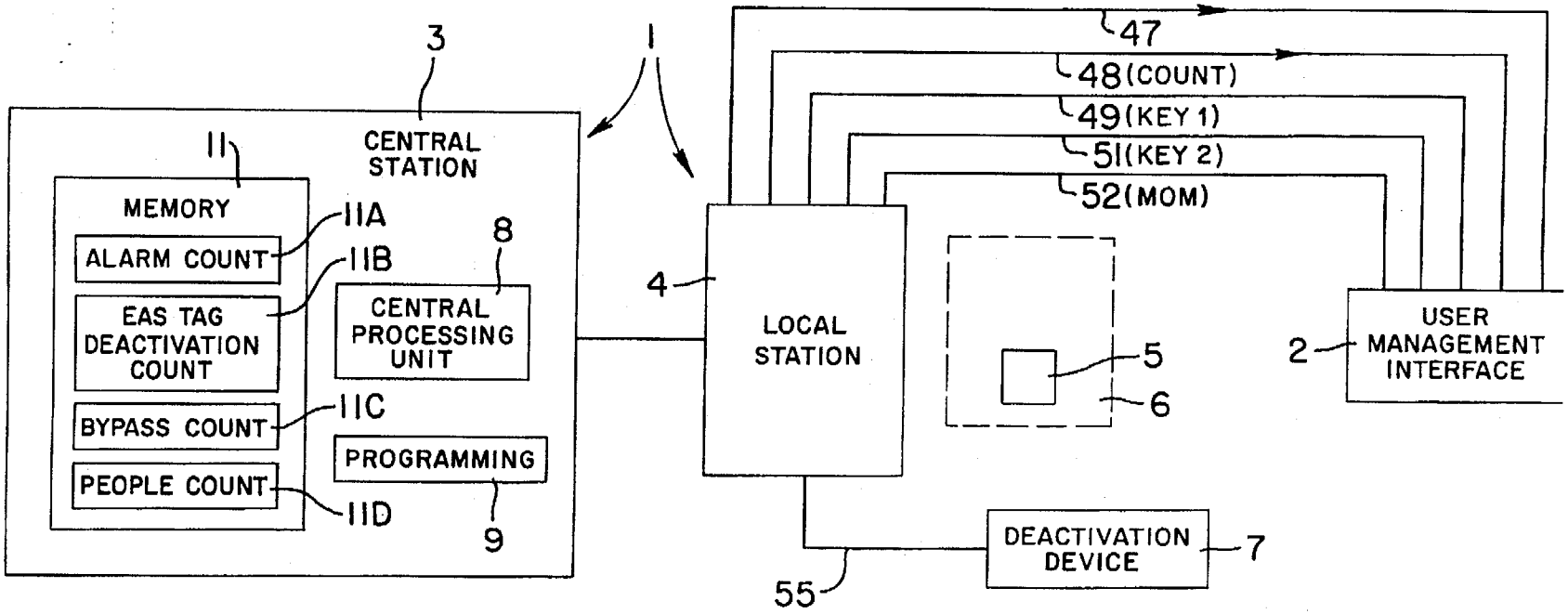
FIG. 1 shows an EAS system including a user management interface in accordance with the principles of the present invention.

FIG. 1 illustrates an EAS system 1 employing a user management interface 2 in accordance with the principles of the present invention. The system 1 includes a central station 3 and a local station 4 for monitoring the presence of EAS tags 5 in an interrogation zone 6. An EAS tag deactivation device 7 permits deactivation of the tags 5 before passage into the zone 6.

At the central station 3, a central processing unit 8 driven by control programming 9 is used to provide overall control of the system 1. A memory 11 is provided for storage of data at the central station 3 and includes memory locations 11A–11D for storing the following EAS system event data to be accessed by the user management interface 2: alarm count data; EAS tag deactivation count data; bypass count data; and people count data.

The alarm count data is generated at the central station 3 by the central processing unit 8 based on the number of alarm conditions established by the central processing unit. The bypass count data is also generated at the central processing unit 8 based on the number of times the EAS system has been disabled by the central processing unit 8 as a result of disable or bypass signals generated at the user management interface 2.

The EAS tag deactivation count data is based on the number of times the deactivation device 7 has deactivated EAS tags 5 in the zone 6. This data is fed to the central processing unit 8 via the local station 4. The people count data is based on the number of people passing through the interrogation zone 6 and is also fed to the central processing unit from the local station 4.

Figure 2:
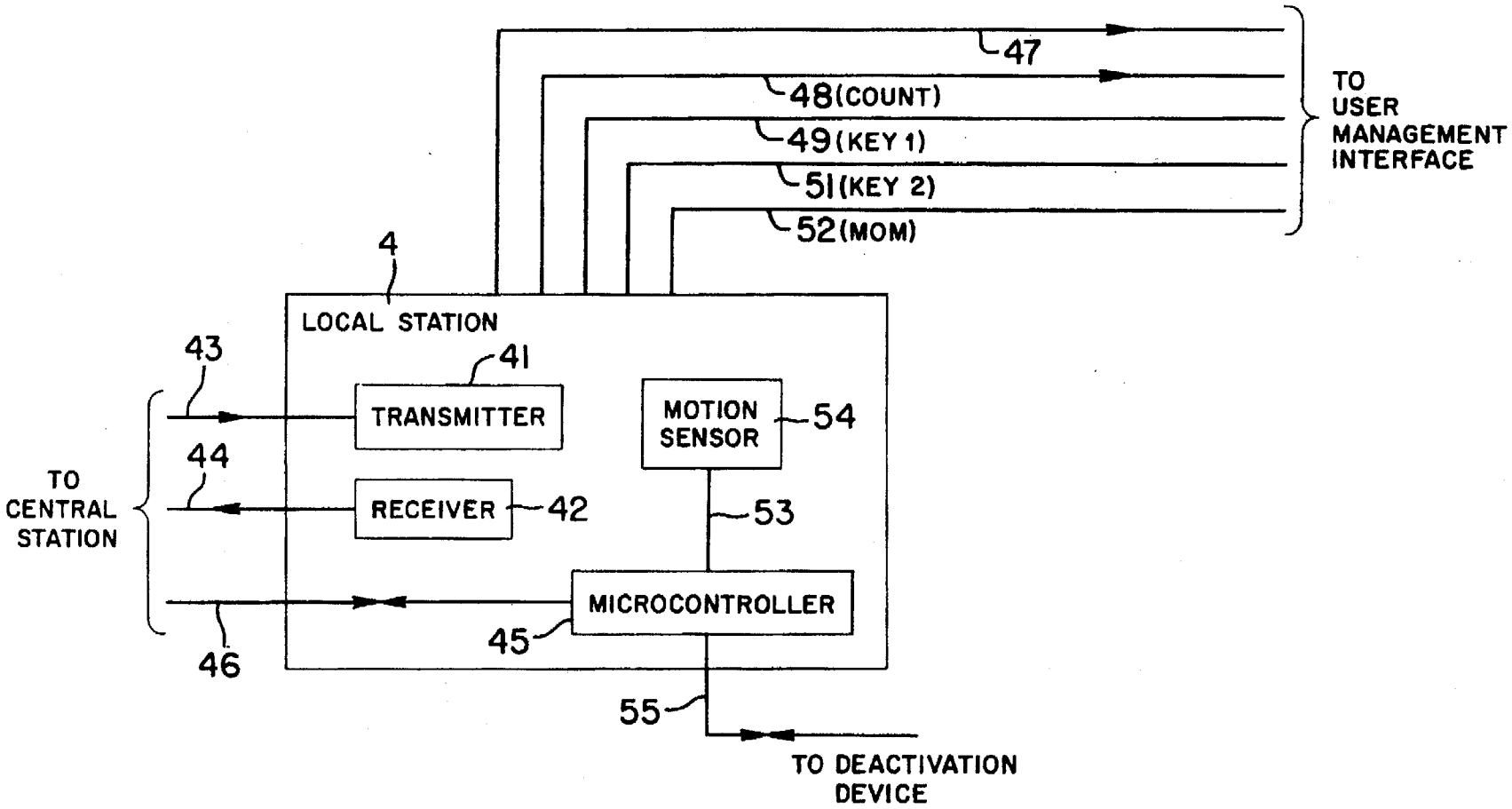
FIG. 2 shows the local station of the EAS system of FIG. 1 in greater detail.

FIG. 2 shows the local station 4 in greater detail. As shown, the local station comprises transmitter and receiver antenna assemblies 41 and 42 which transmit electromagnetic signals into the zone 6 and receive signals from the zone. The transmitter antenna assembly 41 is driven by signals on a line 43 which connects to the central station 3, while the receiver antenna assembly 42 feeds its received signals to the central station 3 over the line 44.

A microcontroller 45 at the station 4 transmits signals to and receives signals from the central station 3 over a bidirectional serial communications path 46. The microcontroller 45 communicates with the user management interface 2 over an outgoing serial-data communications path 47 and an output line 48, labelled COUNT. It receives data signals from the interface 2 over input lines 49, 51 and 52, labelled KEY1, KEY2 and MOM.

The microcontroller 45 also receives signals on an input line 53 from a motion sensor 54 arranged to detect when a person passes through the zone 6. These signals result in the microcontroller 45 transmitting people count data to the central processing unit 8 at the central station 3 to establish the people count event data stored in memory location 11D. Similarly, the deactivation device 7 communicates with the microcontroller 45 over an input/output line 55. These communications result in the microcontroller transmitting deactivation count data to the central processing unit 8 to establish the EAS tag deactivation count event data stored in memory location 11B.

The user management interface 2 permits the user of the EAS system 1 to gain access to the system to establish operating modes for controlling the system and the deactivation device 7. The interface 2 also permits the user to obtain status data and the system event data stored in the memory locations 11A to lid of the memory 11 of the central station 3. This accessing and obtaining of data occurs by the interface 2 communicating with the central processing unit 8 at the central station 3 through the microcontroller 45 which acts to relay information back and forth between the interface and the unit.

It should be noted, however, that the present invention is intended to cover situations where the interface 2 directly communicates with the central processing unit 8. In such case, the need to use the microcontroller 45 as an intermediary is unnecessary.

Figure 3:
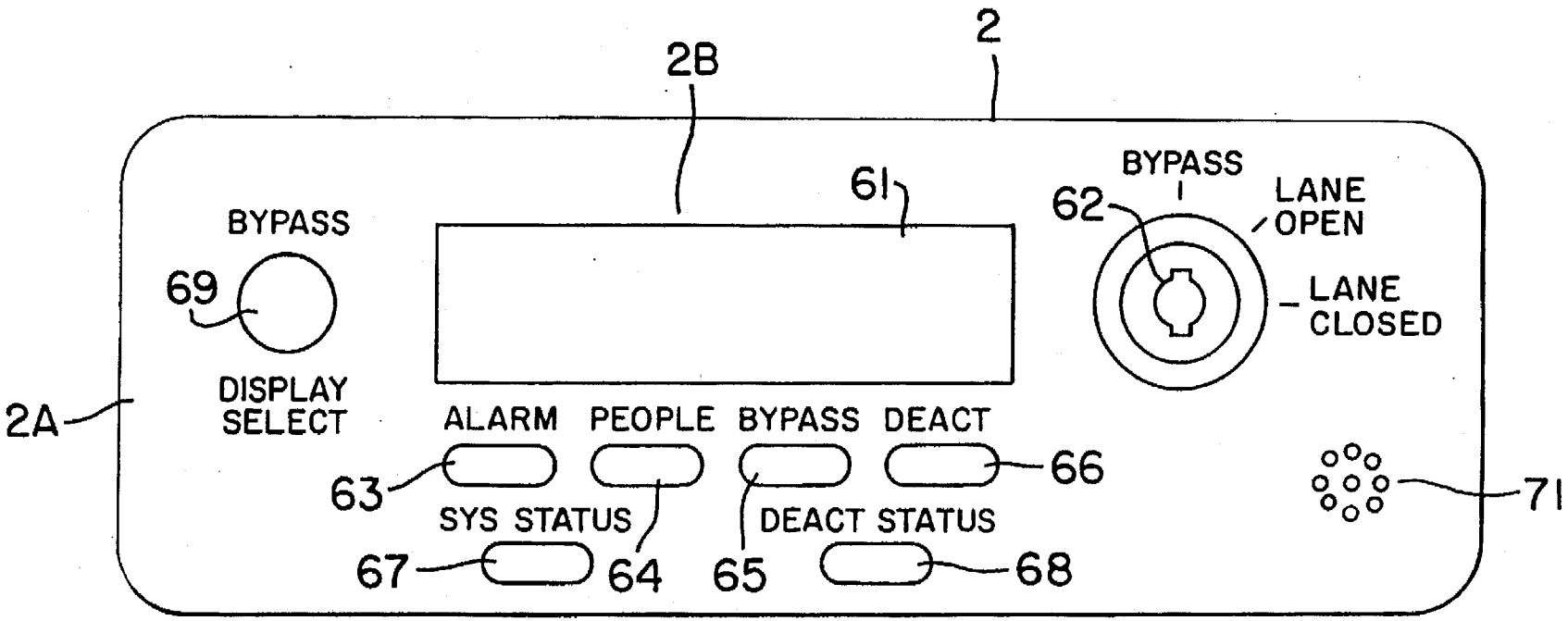
FIG. 3 illustrates in greater detail the front panel of the user management interface of FIG. 1.

In FIG. 3, the front panel 2A of the user management interface 2 is shown in greater detail. As shown, the interface includes a main display 61, a three position key switch 62, status lamps 63–68, a momentary switch 69 and an audible unit 71. The status lamps 63–66 indicate the type of data being displayed on the display 61, as either alarm count data, people count data, bypass count data, or deactivation count data. The lamps 67–68 identify the disabled/enabled status of the EAS system 1 and the deactivation device 7, respectively.

The key switch 62 provides security to the interface 2, since a user must have a security key before the user can operate the interface to gain access to and selectively control the EAS system 1. Once the required security key is inserted in the key switch 62, the user can then select any one of three positions for the switch corresponding to three operating modes.

In one operating mode, corresponding to a vertical orientation of the key switch 62, the interrogation zone 6 is open to traffic and the EAS system 1 can be switched from an enabled state to a disabled or bypassed state for a preselected period of time by momentarily pressing the momentary switch 69. In this mode of operation, the EAS system 1 and deactivation device 7 are normally both enabled. In a second mode of operation, corresponding to the key switch at 45° to the vertical, the interrogation zone is again open to traffic and the EAS system 1 and deactivator 7 are always enabled. In this mode of operation, the different system event data stored at the central station 3 can be accessed and displayed on the display 61 by successively momentarily pressing the momentary switch 69.

In particular, when the momentary switch 69 is first pressed, the alarm count data as stored in the memory location 11A of the memory 11 of central station 3 is displayed on the display 61. At this time, the alarm count status lamp 63 is also enabled or lit to indicate that the alarm count data is being displayed. When switch 69 is pressed again, the deactivation count data as stored in memory location 11B of the memory 11 of the central station 3 is displayed on the display 61 and the deactivation count status lamp 66 is enabled or lit. When switch 69 is pressed a third time, the bypass or disable count data as stored in the memory location 11C of the memory 11 of the central station 3 is displayed on the display 61 and the bypass count status lamp 65 is enabled or lit. Finally, when pressed a fourth time, the people count data as stored in the memory location 11D of the memory 11 of the central station 3 is displayed on the display 61 and the people count status lamp 64 is enabled or lit.

In a final or third position of the key switch 62 with the switch horizontal, the interrogation zone 6 is closed to traffic and the EAS system 1 is enabled and the deactivation device 7 is disabled. In this mode of operation, the momentary switch 69 can again be momentarily depressed to sequentially gain access to the system event data in the memory 11 of the central station 3, as just described for the key switch in the second switch position. Additionally, in this third switch position, since the deactivation device 7 is disabled, unauthorized use of the device by someone passing through or adjacent to the interrogation zone 6 is prevented.

During each of the aforesaid modes of operation, the EAS system status lamp 67 and the deactivation device status lamp 68 of the interface 2 are enabled or lit when the respective component is in an enabled condition. Thus, in the first and second modes, the lamps 67 and 68 are both normally lit, while in the third mode only the lamp 67 is normally lit.

When the access key is removed from the key switch 62, the operating mode is governed by the position of the key switch when the key was removed. The mode of operation will thus be either the first, second or third mode and the interface will function accordingly. However, with the access key removed, the user will not be able to switch to any of the other operating modes.

As will be explained in greater detail below, the operation of the key switch 62 and the momentary switch 69, as above-described, controls the states or voltage levels of the KEY1 line 49, the KEY2 line 51 and the MOM line 52 connecting the interface to the local station 4. These states or voltage levels are, in turn, monitored and stored by the microcontroller 45 at the local station.

The microcontroller 45 and the central processing unit 8 at the central station 3 communicate with each other over the bi-directional communication path 46 during preselected periodic intervals $t_1$ and $t_c$, respectively. During each periodic interval $t_1$, the microcontroller 45 transmits a digital message containing data corresponding to the aforesaid states of the KEY1, KEY2 and MOM lines to the central processing unit 8. The central processing unit 8, upon receipt of this message, recognizes from this data, the states of the KEY1 and KEY2 lines and, therefore, the operating mode selected by the key switch. Based on the recognized mode, the central processing unit 8 appropriately processes the corresponding state of the MOM line which it also recognizes from the data in the transmitted message.

Having recognized the operating mode and processed the MOM line state, the central processing unit 8 then transmits a response message or messages to the microcontroller 45. This message or these messages are transmitted in one or more of the periodic transmission intervals $t_c$. The microcontroller 45 then responds to these messages by relaying appropriate corresponding messages to the interface 2 and the deactivation device 7.

A first type of message which is relayed by the microcontroller 45 to the interface 2 contains data for establishing state signals for controlling the enabled/disabled conditions of the status lamps 63–68. This first type of message also contains data for resetting the display 61 and for controlling the enabled/disabled condition of the audio unit 71. This first type of message is transmitted as a serial bit stream over the serial communication path 47.

A second type of message which is relayed by the microcontroller 45 to the interface 2 contains data for establishing signals for controlling the information displayed by the display 61. This message is transmitted over COUNT line 48.

Before discussing in greater detail the messages transmitted among the central processing unit 8, the microcontroller 45 and the interface 2, the reset capability of the interface 2 when in the third operating mode will be discussed. When in this mode of operation, the interface 2 is further adapted, in response to a magnet brought adjacent the position 2B on its front panel 2A, to change the state or voltage level of the KEY2 line from that indicative of the third mode.

This change in state of the KEY2 line is stored at the microcontroller 45 and on the next periodic transmit interval $t_1$ of the microcontroller, it will be reflected in the data of the message sent from the microcontroller to the central processing unit 8. The central processing unit 8 recognizes from this data in the received message that the particular one of the memory locations 11A–11D whose count data is currently being displayed on the display 61 is to be reset to zero. The central processing unit 8 then sets this memory location to zero and sends a response message to the microcontroller indicating that the information being displayed by the display 61 is to be reset to zero.

Once this message is received at the microcontroller 45, the microcontroller 45 then relays this message over the path 47 to the interface 2, whereupon the current count on the display 61 is reset to zero.

Figure 4:
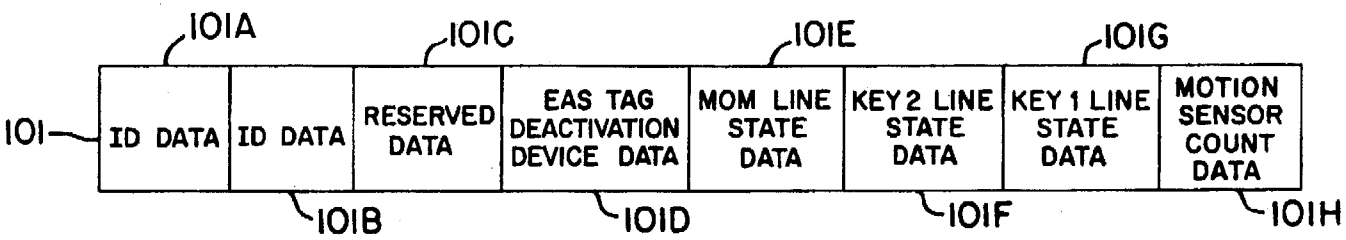
Figure 5:
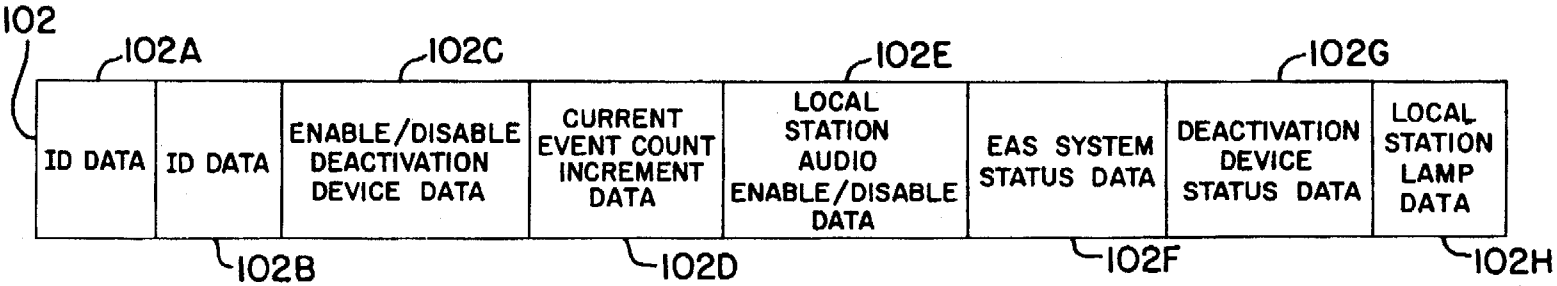
Figure 6:
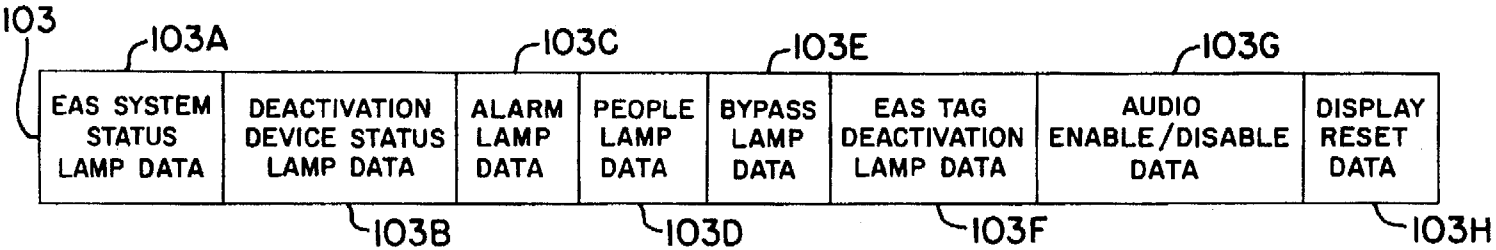
Figure 11A:
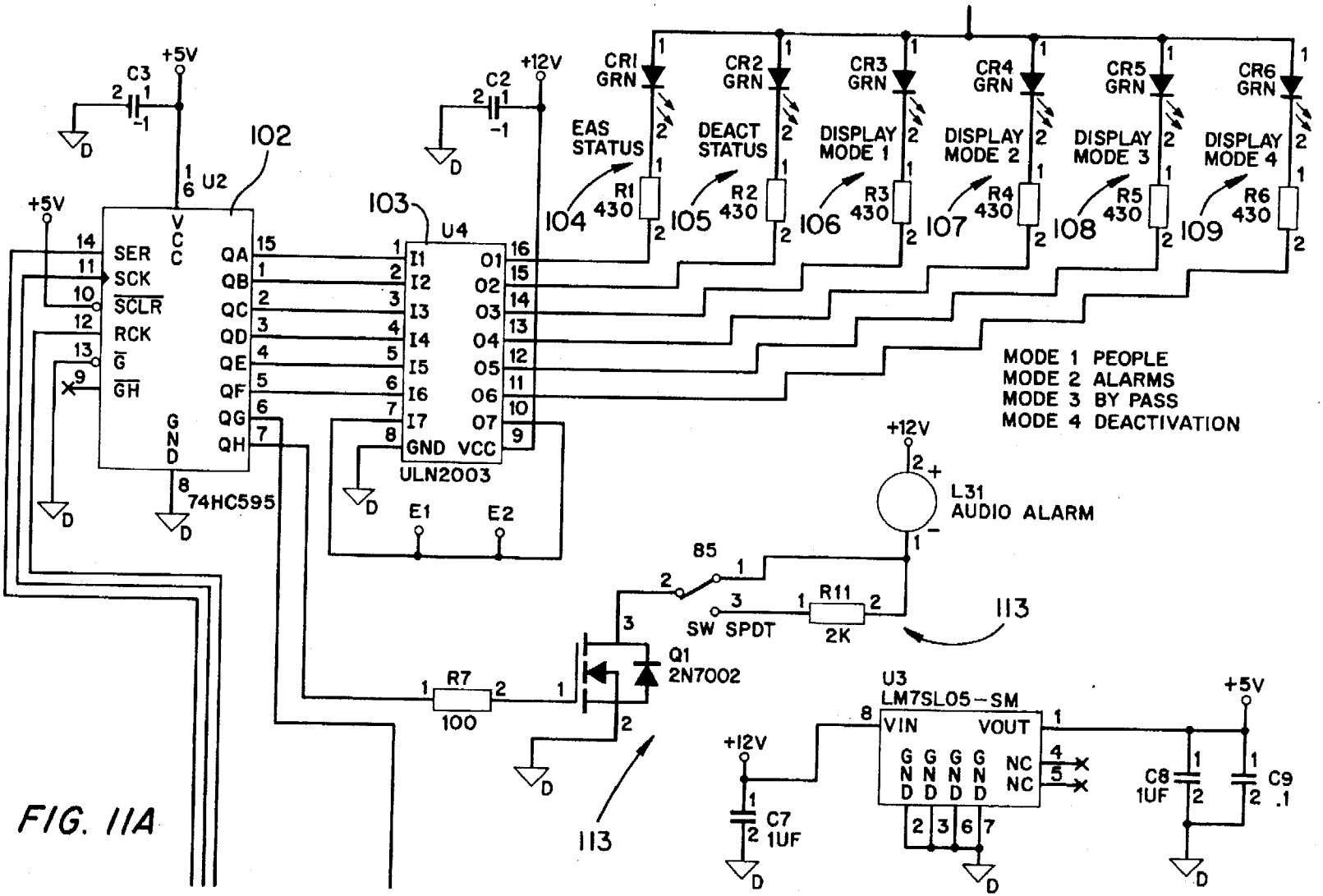
FIG. 11 illustrates a circuit implementation of the user management interface of FIG. 1.
Figure 11B:
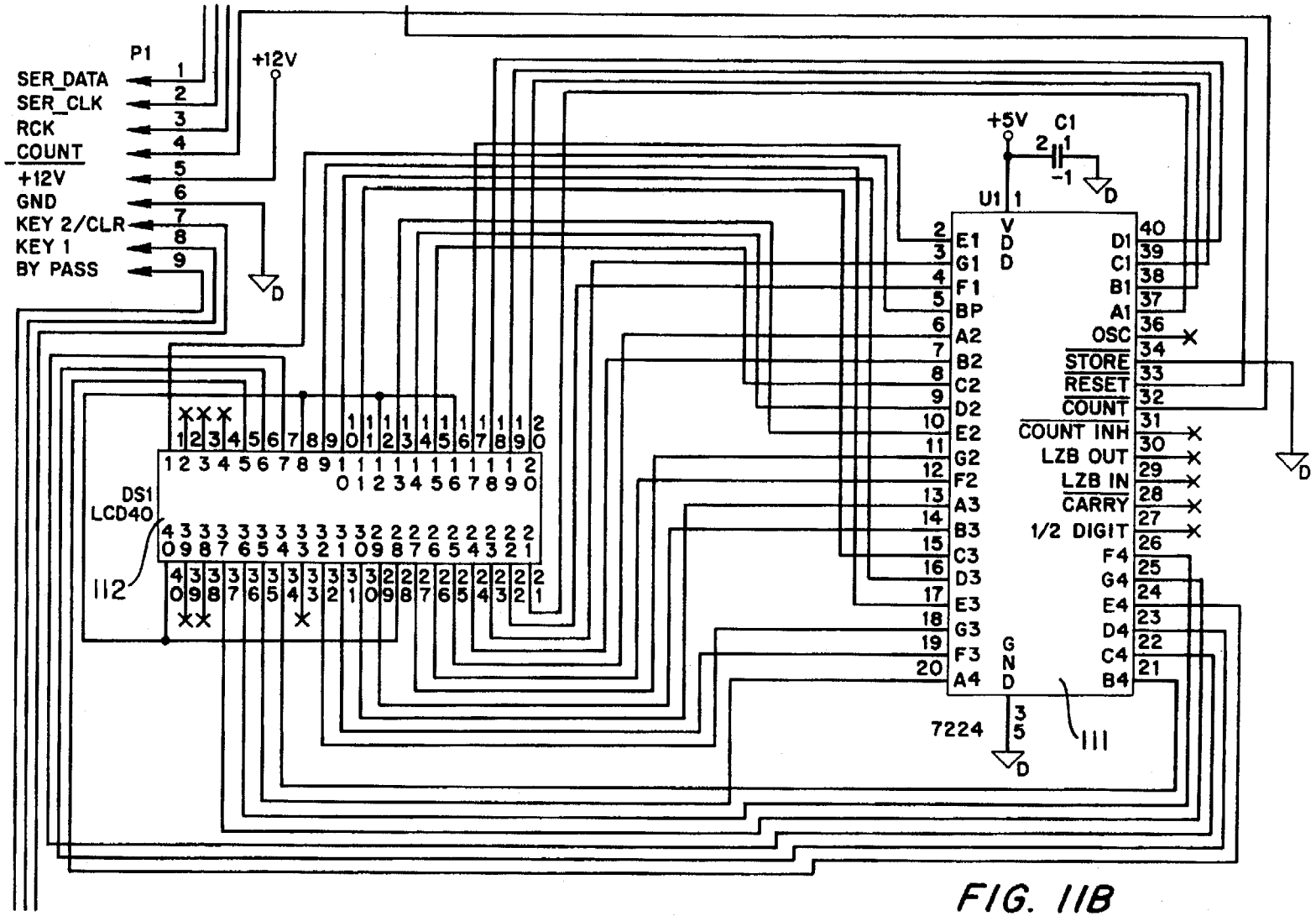
Figures 11, 11A, 11B, 11C:
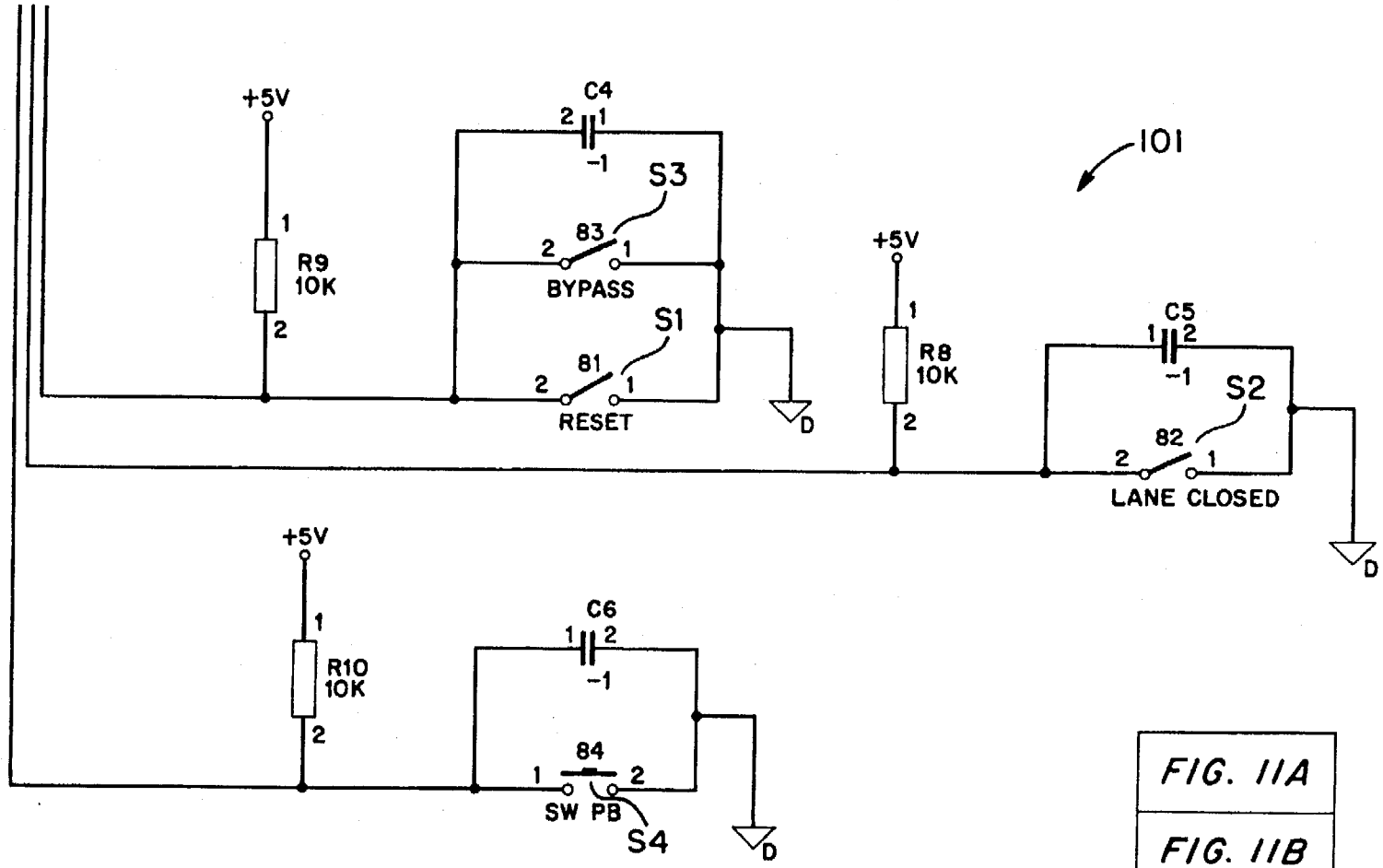

FIG. 4 illustrates the digital message 101 normally being transmitted in each periodic interval $t_1$ from the microcontroller 45 to the central processing unit 8. FIG. 5, in turn, illustrates the digital message 102 normally being transmitted in each periodic interval $t_c$ from the central processing unit 8 to the microcontroller 45. FIG. 6 shows the serial message 103 normally being relayed or transmitted by the microcontroller 45 to the interface 2 on the serial communications path 47. FIG. 7 illustrates the messages 104A, 104B and 104C transmitted from the central processing unit 8 to the microcontroller 45 to convey system event count data in response to the switch 69 being momentarily pressed in the second and third operating modes.

The message 101 contains message identifier data 101A, 101B, a reserved data position 101C, EAS tag deactivation device count data 101D, MOM line state data 101E, KEY2 line state data 101F, KEY1 line state data 101G and motion sensor count data 102H. The message 102 contains identifier data 102A, 102B, enable/disable deactivation device data 102C, current event count increment data 102D, local station audio enable/disable data 102E, EAS system status data 102F, deactivator device status data 102G and a local station lamp enable/disable data 102H.

The message 103 contains EAS system lamp data 103A, deactivation device status lamp data 103B, alarm lamp data 103C, people lamp data 103D, bypass lamp data 103E, EAS tag deactivation lamp data 103F, audio enable/disable data 103G and display reset data 103H.

The messages 104A and 104B contain count data Count0 to Count7 and Count8 to Count15 for the high and low bit count for the display 61. The message 104C contains audio frequency data Audo1 to Aud3, reserved data R and display data Disp0 and Disp1 which together indicate which event count status lamp is enabled based on the table shown in FIG. 10.

As indicated above, the message 101 is transmitted in the respective periodic intervals $t_1$ from the microcontroller 45 to the central processing unit 8. The data 101D and 101H in the message 101 is understood by the central processing unit 8 as indicative of increments in the EAS tag deactivation count and the people count. Accordingly, based on this data, the central processing unit 8 increments the memory locations 11B and 11D storing the counts of these system events.

How the other data in the message 101 and how the data in the other messages 102, 103 and 104A–D are understood and processed is contained in the following description in which the above-mentioned operating modes are described in terms of the sequences of messages transmitted among the interface 2, microcontroller 45 and the central processing unit 8. In the first mode of operation, corresponding to the vertical position of key switch 62, the KEY1 line 49 is at a high voltage level and the KEY2 line 51 is at a low voltage level. The microcontroller 45 recognizes and stores these voltage levels or states and in its next periodic transmission of a message 101 to the central processing unit 8, the transmitted message 101 carries the KEY1 and KEY2 line state data 101G and 101F indicative of these high and low states.

When the message 101 is received at the central processing unit 8, the processing unit 8 recognizes from the KEY1 and KEY2 line state data, the high and low states of the KEY1 and KEY2 lines, respectively. The central processing unit 8 understands from these states that the user has selected the first operating mode. Accordingly, the unit 8 further understands that subsequent messages 101 having MOM line state data 101E indicating a momentary depression of the switch 69, should be responded to by the central processing unit 8 disabling the EAS system 1 for a preselected period of time. The unit 8 also understands that in this first operating mode the display 61 should be set to and held at the alarm count.

If the alarm count is not being displayed at the time of placing the key switch 62 in the first mode position, the central processing unit 8 recognizes this from its stored information indicating the system event data currently being displayed. The unit 8 then assembles and transmits to the microcontroller 45 messages 104A–C which contain data for causing the display 61 to display the alarm count and for causing the alarm count status lamp 63 to be lit. Upon receipt of these messages, the microcontroller 45 relays to the interface 2, on the COUNT line 48 and on the serial path 47, respectively, the appropriate alarm count and lamp status data or information. The interface 2, in turn, responds to this information by displaying the current alarm count in the display 61 and by lighting the alarm count status lamp 63.

If the user now momentarily presses the switch 69, the MOM line 52 is brought to a low voltage level. This change in voltage level or state is recognized and stored by the microcontroller 45. In the next message 101 sent by the microcontroller 45 to the central processing unit 8, the MOM line state data 101E is changed to reflect the change in state of the MOM line 52. This change in data is recognized and understood by the central processing unit 8 and, in response thereto, the unit 8 disables the EAS system 1 for a preselected period of time. The central processing unit 8 accomplishes this by, for example, disabling signal power to the transmitter 41.

In the next message 102 periodically sent by the central processing unit 8 to microcontroller 45, the central processing unit 8 changes the system status data 102F to indicate disabling of the EAS system 1. Upon receipt of the message 102, the microcontroller 45 changes the EAS system status data 103A in the serial message 103 sent on path 47 to the interface 2. The interface 2, in turn, recognizes this change in data and disables the EAS system status lamp 67 to indicate that the system has been disabled.

When the EAS system 1 is enabled after the preselected time interval, by, for example, the central processing unit 8 again causing power to be delivered to the transmitter 41, the next periodic message 102 sent by the central processing unit 8 will reflect a change in the EAS system status data 102F indicating enabling of the EAS system 1. This change in data will again be relayed by the microcontroller 45 via a change in the system status data 103A in the serial message 103 on line 47. The user interface 2 recognizes this change in data, causing the system status lamp 67 to be again enabled, indicating active status for the EAS system 1.

Subsequent momentary depressions of the switch 69 in this first mode of operation will result in the same sequence of events, i.e., the system 1 will be disabled for a preselected period of time, status lamp 67 will be disabled, the system 1 will be enabled after the preselected period of time, and status lamp 67 will be enabled upon enabling of the system.

If the key switch 62 is now rotated to the 45° position, the second mode of operation is now selected. In this mode of operation, the KEY1 line 49 remains at a high voltage level and the KEY2 line goes to a low voltage level. These states or voltage levels of the lines 49 and 51 are monitored and stored by the microcontroller 45 and in its next periodic message 101, the change in state of the line 51 is reflected by a change in the KEY2 line data 101F.

When the message 101 is received by the central processing unit 8, the unit 8 recognizes from the change in the KEY2 line data and from the KEY1 line data that the second operating mode has now been selected. The central processing unit 8 then understands that any subsequent change in the MOM line data 101E is a request to display the system event data for the next successive system event.

If the momentary switch 69 is now pressed, the MOM line 52 is brought to a low voltage level or state which is monitored and stored by the microcontroller 45. The microcontroller 45 in its next message 101 then changes the MOM line data 101E. Upon receipt of the message 101 at the central processing unit 8, the unit 8 recognizes from the change in the MOM line data 101E that the next system event data is to be displayed.

The central processing unit 8 in its next periodic transmission intervals then transmits messages 104A–104C having data corresponding to the next system event count and to the status lamp to be enabled. The microcontroller 45 then relays corresponding data to the interface 2 in a message 103 over the serial communications path 47 indicating the system event status lamp to be enabled and over the COUNT line 48 indicating the system event count as stored in the corresponding memory position. The interface 2 receives this data and displays the appropriate system event count data on display 61 and enables the appropriate system event status lamp.

Subsequent momentary depressions of the switch 69 result in the same sequence of events, with the central processing unit 8 stepping through the system event data with each depression. The user interface 2 is thus stepped through display of the other system event count data and the corresponding system event status lamps are enabled.

If the key switch 62 is now rotated to the horizontal position, the KEY2 lines go to a high voltage level or state and one KEY1 line 49 goes to a low voltage level or state. Again, this change in state of the lines 49 and 51 is monitored and stored at the microcontroller 45. In the next periodic message 101 transmitted to the central processing unit 8, the KEY1 and KEY2 line data is changed to reflect the changes in state of the lines 49 and 51. When the message 101 is received by the central processing unit 8, the unit 8 recognizes from this change in the data that the third operating mode is selected. It also recognizes that as a result of this selection, changes in the MOM line data in subsequent messages 101 require the stepping through and transmitting of the different system event data, as was carried out in the second mode. Accordingly, subsequent depressions of the momentary switch 69 will then result in the display 61 displaying successively the different system event count data, as previously described.

In this third operating mode, the central processing unit 8 also recognizes that the deactivation device 7 is to be disabled. As a result, in its next periodic message 102 after receiving the message 101, the central processing unit changes the deactivation device enable/disable data 102C. When this message is received at the microcontroller 45, the microcontroller recognizes from the change in the data that the deactivator device 7 is to be disabled. A disable signal is then communicated by the microcontroller 45 over the line 55 to the deactivation device 7, whereby the device 7 is disabled.

As previously described, in this third mode of operation, the system event data being currently displayed on the display 61 can be reset to zero by bringing a magnet adjacent to the front panel of the interface 2. In doing so, the KEY1 line 49 takes on a low voltage or state and this change is again monitored and stored by the microcontroller 45.

In the next periodic transmission of the message 101 by the microcontroller 45, the KEY2 line data 101F is changed to reflect the change in state of the KEY2 line. When the message 101 is received by the central processing unit 8, the central processing unit recognizes from the change in data that the system status event data currently being displayed is to be zeroed. The central processing unit 8 then zeros the current system event data in the appropriate memory location 11A to 11D.

In its next periodic transmissions, the central processing unit 8 transmits messages 104A–104C having count data indicative of resetting of the current system event data. This message is received at the microcontroller 45 which understands from the change in data that the display 61 is to be reset. The microcontroller then changes the display reset data 103H in the message 103 on the path 47. This is recognized at the interface 2 which, in turn, changes the display 61 to zero.

If the other system event data is to be reset, the momentary switch 69 is first pressed to display the desired system event data to be zeroed. The magnet is then passed by the face of the interface 2 and this system event data being displayed is reset to zero in the same manner as just described.

In each of the above modes of operation, when a message 101 is transmitted to the central processing unit 8, the message will report any increments in people count and EAS tag deactivation count occurring in the time from when the previous message 101 was transmitted. This is reflected by a change in the respective data 101D and 101H. When the message 101 is received by the central processing unit 8, the unit will recognize from this change in data that the people count and deactivation count must be appropriately incremented. The unit 8 will then update the data in the appropriate memory locations 11B and 11D.

In each message 102 transmitted from the central processing unit 8 to the microcontroller 45, if the status event data currently being displayed has been incremented in the corresponding memory location, this increment is reflected by a change in the current event COUNT increment data 102D. The microcontroller 45 recognizes this change in data and relays a corresponding change to the interface 2 via the COUNT line 48. The interface 2 then updates the display 61 to increment the count being displayed.

FIG. 8 shows a detailed circuit 101 for implementing the user management interface 2. The circuit includes serial to parallel converter 102, status lamp driver 103, status lamp circuits 104–109, display driver 111, an LCD display 112 and alarm circuit 113. The circuit 101 also includes switches S1, S2, S3 and S4 which are controlled by the key switch 62 so that the following occurs: in mode 1, switch S3 is closed, switches S1 and S2 are open and switch S4 can be closed and opened; in mode 2, switches S1, S2 and S3 are open and switch S4 can be opened and closed; and in mode 3, switches S3 and S1 are open, switch S2 is closed and switch S4 can be opened and closed. Additionally, in mode 3, switch S1 can be closed by the magnetic force of a magnet placed adjacent to the front panel 2A of the interface 2.

The user management interface 2 can be modified in various ways to provide enhanced security and control. Thus, the interface can be modified to include a numeric keypad to allow for access code entry by a user. Such a keypad would allow for the following: user I.D. log-in; user command entry; and secure control of the system disable feature. Additionally, the aforesaid keypad may be incorporated into a touch-screen which can also serve as a display for the interface. The touch-screen may be implemented in a "soft key" scheme in which the functions of the touch-screen buttons and the resulting indications are context sensitive, and change interactively, depending upon user choices.

Figure 12:
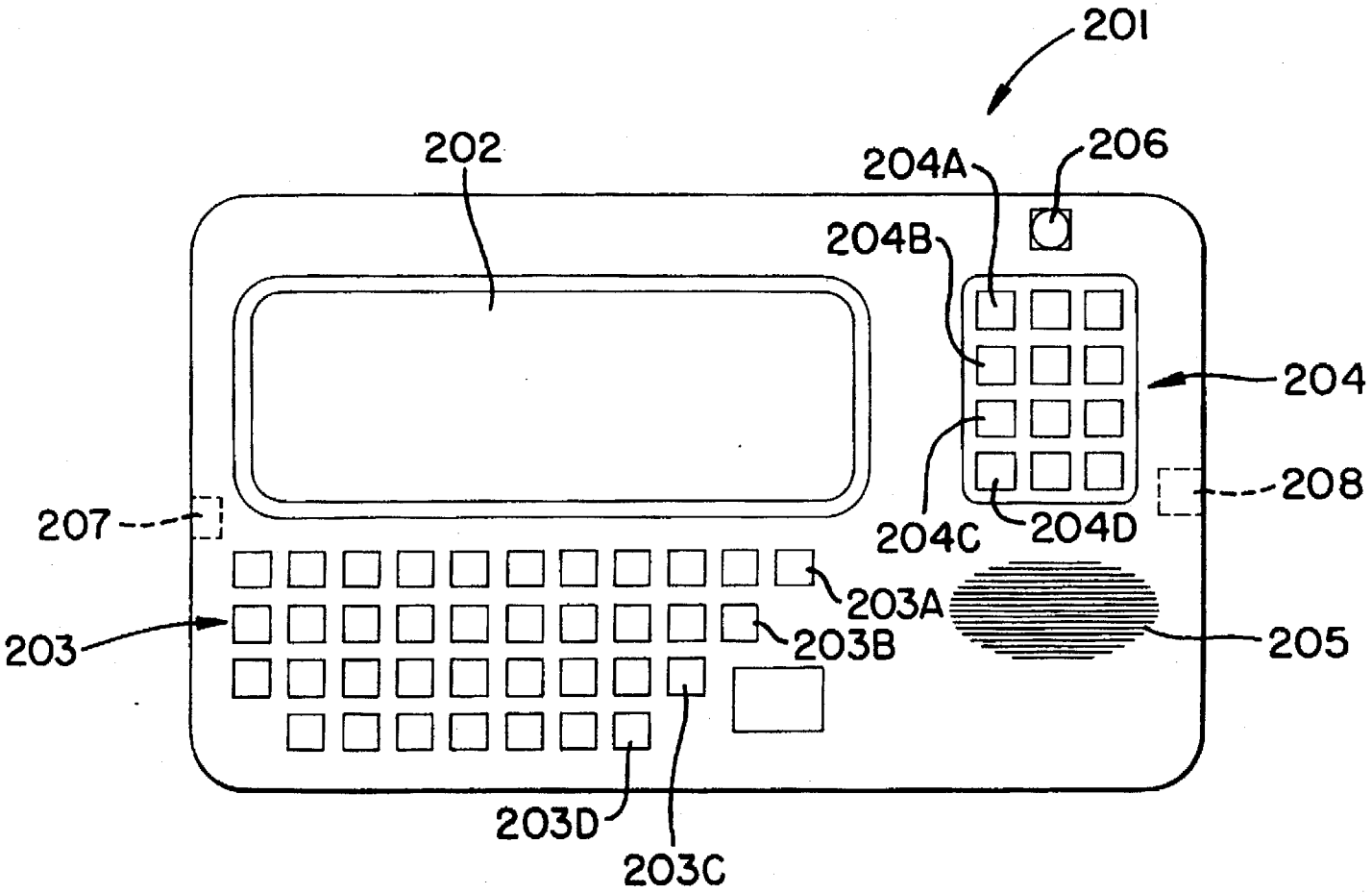
FIG. 12 shows a further embodiment of a user management interface in accordance with the principles of the present invention.

FIG. 12 shows the front panel of a user management interface 201 modified in this way and to further increase the functionality of the interface. As shown, the interface 201 includes a graphic numerical display 202 for displaying system event and other data. A full featured keyboard 203 having rows of keys 203A, 203B, 203C and 203D allows entry of information, including information for identifying the EAS system status event data to be displayed.

The top row of keys 203A can be user defined or context driven. The function of each key is displayed in a row at the bottom of the display.

A numeric key pad 204 with rows of keys 204A, 204B, 204C and 204D permits user access to the interface by entry of a user identification or pin number. These keys also can serve to define the modes of operation of the interface similar to the key switch of the interface 2.

A speaker/microphone unit 205 permits audio output from the interface and audio input to the interface. The speaker/microphone can be button or voice activated.

A digital interface port 207 is used to communicate with the local station 4. Alternatively, an infrared transceiver 206 is provided and allows communication between the interface and the local station and/or direct communication with the central station 3.

A video imager input port 208 permits video signals to also be input to the interface.

Figure 13:
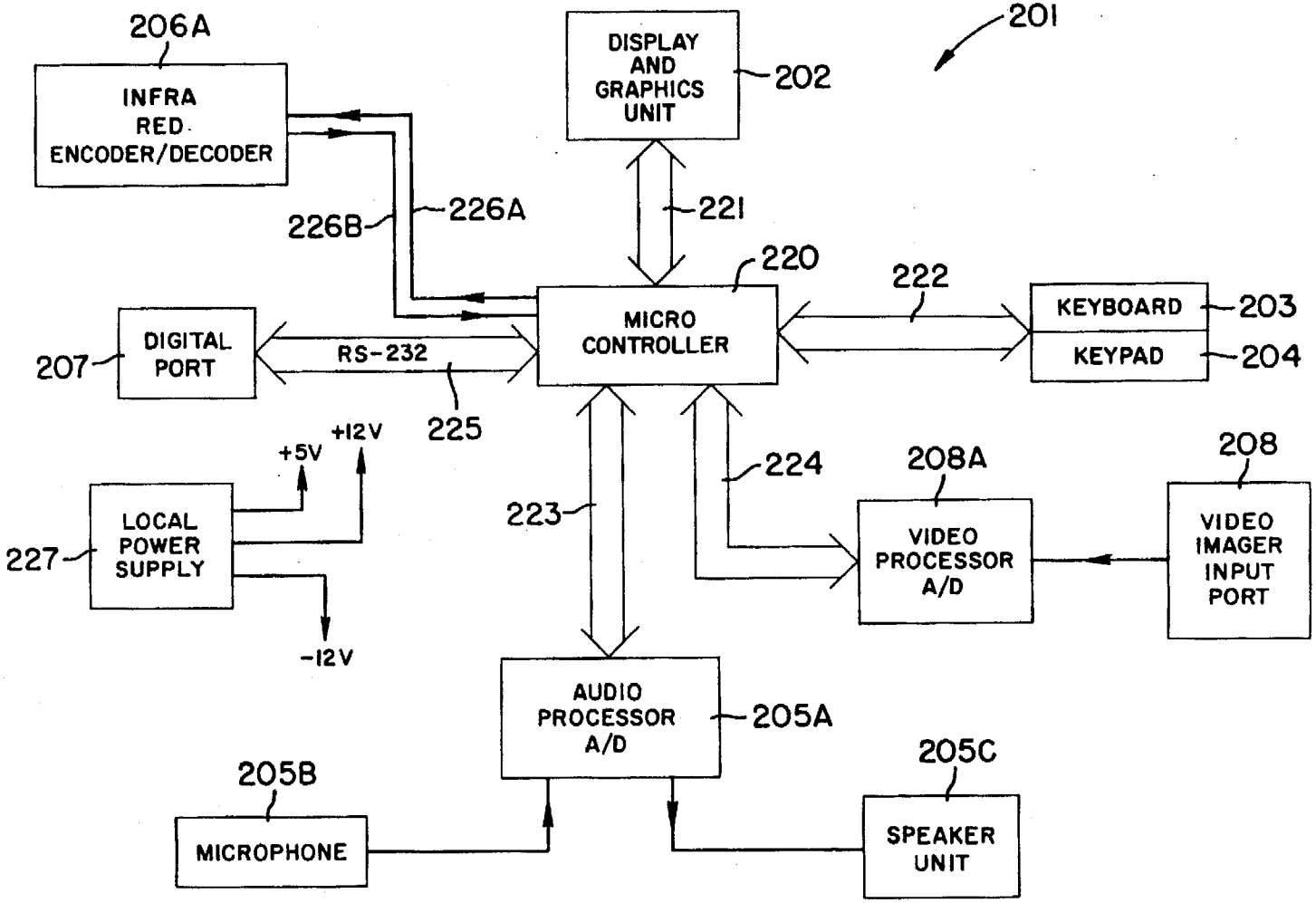
FIG. 13 depicts a block diagram of the user management interface of FIG. 12.

FIG. 13 shows a block diagram of the circuit elements forming the interface 201. A microcontroller 220 controls operation of the interface. The microcontroller communicates on digital lines 221 and 222 with the display 202 and the keyboard 203 and the keypad 204.

The microcontroller also communicates on a further digital line 223 with an audio processor and A/D converter unit 205A of the speaker/microphone unit 205. This unit includes a microphone unit 205B and a speaker 205C connected to the audio processor 205A. A further digital line 224 couples the microcontroller 220 with a video processor and A/D converter 208A. This processor connects to the video imager input port 208 The microcontroller 220 also couples with the digital interface port 207 via an RS-232 line 225. Further lines 226A, 226B connect the microcontroller to an infrared decoder/encoder 206A of the infrared transceiver unit 206. Power for the interface is provided by a local supply 227.

The microcontroller 220 coordinates the operation of the aforesaid components to which is connected or with which it communicates. Entries from the keyboard 203 and the keypad 204 are used to invoke operation of the microcontroller which processes the entries with appropriate action.

In some cases, these entries cause the microcontroller to format messages which are then outputted via the RS-232 line 225 and digital interface port 207 and/or used as inputs to the display 202. Messages which are outputted from the digital interface port 207 are passed to the local station 4 which then relays them to the central station 3. Messages which are input to the display 202 are used to drive the display element and appropriate displays are generated.

Display messages are also generated by the microcontroller 220 and input to the display based on messages received from the central station 3. These messages are passed by the local station 4 to the digital interface port 207 of the interface. The messages are then coupled by the RS-232 line to the microcontroller 220. Alternatively, messages can be communicated directly to the interface from the central station and/or local station via infrared signals. These signals are coupled to the infrared decoder/encoder 206A and then to the microcontroller 220.

The speaker/microphone unit 205 permits audio inputs to and audio outputs from the interface. Audio inputs are converted to digital signals and digital signals are converted to audio outputs via the audio processor and A/D converter 205A. These signals are fed to and received from the microcontroller 220. Signals received by the microcontroller are either used by the microcontroller to conduct an activity at the interface or to transmit messages to the central station 3.

The speaker/microphone unit 205 allows for audio input and output during EAS system alarm events. It can be used as an intercom with storage, paging and monitoring capabilities.

Video image input port 208 allows for video information to be received at the interface from video equipment at the interface location. This equipment might be triggered by an alarm event at the location. A video processor and A/D converter 208A at the interface converts video image information to digital format. This information is then encoded by the microcontroller for transmission to the central station 3.

As above-noted, the display 202 and keyboard 203 of the interface 201 allow for the input of information to the interface and the passage of information from the interface to the central station 3 via the local station 4. The information displayed on the display can be EAS system status data, as above-mentioned, as well as count and diagnostic data. Additionally, the display can be used as a visual feedback for inputs at the keyboard 203. As an example, after an alarm condition in the EAS system, the party accessing the interface may have to enter a PIN code via the keypad 204 and/or may have to select values or actions via the keyboard 203 based on a menu displayed on the display 202 and associated with the alarm event. Furthermore, the interface 201 allows for the input of a wide variety of data relevant to the activities of employees and/or customers of the entity employing the interface.

A further modification of the interface 201 might be use of additional audible and visual indicators for system status and alerts. These might include synthesized voice prompts and status indications.

In all cases it is understood that the above-described arrangements are merely illustrative of the many possible specific embodiments which represent applications of the present invention. Numerous and varied other arrangements, can be readily devised in accordance with the principles of the present invention without departing from the spirit and scope of the invention.

What is claimed is:

1. A user management interface for user interaction, monitoring and control of an electronic article surveillance ("EAS") system comprising:

user accessible input means for actuation by a user;

generating means responsive to said user accessible input means for generating signals for interacting with said EAS system; and receiving means for receiving signals from said EAS system to provide indications with respect thereto, said signals received by said receiving means from said EAS system including signals indicative of EAS system event data.

2. A user management interface in accordance with claim 1 wherein:

said interacting includes one or more of controlling the enabling and disabling of said EAS system.

3. A user management system in accordance with claim 2 wherein:

said receiving means includes display means for displaying said EAS system event data and an indication of the type of data being displayed.

4. A user interface in accordance with claim 3 wherein:

said EAS system event data includes one or more of the following: the number of alarm conditions of said EAS system; the number of people passing through said EAS system; the number of disablements of said EAS system; and the number of a times EAS tags in said EAS system have been deactivated.

5. A user management interface in accordance with claim 4 wherein:

said signals received by said receiving means from said EAS system further include signals indicative of the enabled and disabled states of one or more of an EAS tag deactivation device and said EAS system;

and said receiving means includes further display means for displaying the enabled and disabled states of one or more of said tag deactivation device and said EAS system.

6. A user management interface in accordance with claim 5 wherein:

said generating means includes further means for generating a signal indicative of resetting said EAS system event data being currently displayed by said display means to zero.

7. A user management interface in accordance with claim 6 wherein:

said further means of said generating means is responsive to a magnet brought adjacent said user management interface.

8. A user management interface in accordance with claim 6 wherein:

said signals received by said receiving means include signals for resetting said EAS system event data being currently displayed by said display means to zero.

9. A user management interface in accordance with claim 5 in which said user management interface has one or more operating modes;

said user accessible input means is adapted to allow said user to select a particular operating mode; and said signals generated by said generating means include signals indicative of each selected operating mode.

10. A user management interface in accordance with claim 9 wherein:

in a first operating mode, first actuations of said user accessible input means by said user following actuation of said user accessible input means to select said first mode are each indicative of a request by said user to disable said EAS system; and said generating means in response to each said first actuation generates a signal which is understood by said EAS system as an instruction to disable said EAS system.

11. A user management interface in accordance with claim 10 wherein:

said receiving means upon disablement of said EAS system receives a signal indicative of said disablement and said receiving means causes said further display means to display the disabled state of said EAS system.

12. A user management interface in accordance with claim 10 wherein:

in a second operating mode, second actuations of said user accessible input means by said user following actuation of said user accessible input means to select said second operating mode, allow said user to sequentially access said EAS system event data;

said generating means in response to each said second actuation generates a signal which is understood by said EAS system as a request to transmit EAS system event data and an identification of said EAS system event data to said management interface;

and said receiving means receives said transmitted EAS system event data and said identification of said EAS system event data and causes said display means to display said EAS system event data and to display said identification of said EAS system event data.

13. A user management interface in accordance with claim 12 wherein:

in a third operating mode, said EAS system recognizes the selection of said third operating mode as an instruction to cause disabling of a deactivation device and said deactivation device is disabled and third actuations of said user accessible input means by said user following actuation of said user accessible input means to select said third operating mode allow said user to sequentially access said EAS system event data;

said generating means in response to each said third actuation generates a signal which is understood by said EAS system as a request to transmit EAS system event data and an identification of said EAS system event data to said management interface;

and said receiving means receives said transmitted EAS system event data and said identification of said EAS system event data and causes said display means to display said EAS system event data and to display said identification of said EAS system event data.

14. A user management interface in accordance with claim 13 wherein:

said user accessible actuation means comprises: a key switch having first, second and third positions for selecting said first, second and third operating modes; and a momentary switch for effecting said first, second and third actuations;

said display means includes: a main display for displaying said system event data; an EAS system status lamp; and system event lamps each indicative of a different one of said EAS system events;

and said generating means includes a switch assembly responsive to said key switch for generating said signals indicative of said operating modes.

15. A user management interface in accordance with claim 14 wherein:

said switch assembly is further responsive to a magnet brought adjacent said user management interface for generating a signal indicative of resetting said EAS system event data being currently displayed by said display assembly to zero.

16. A user management interface in accordance with claim 15 wherein:

said switch assembly is responsive to said magnet for generating said signal indicative of resetting said EAS event data being currently displayed to zero in said third operating mode.

17. A user management interface in accordance with claim 1 wherein:

said generating means includes a microcontroller.

18. A user management interface in accordance with claim 17 wherein:

said generating means includes a keyboard means;

and said microcontroller is responsive to said keyboard means.

19. A user management interface in accordance with claim 18 wherein:

said keyboard means includes: a keyboard for entering requests to said microcontroller for EAS system status event data; and a keypad for supplying identification information to said microcontroller.

20. A user management interface in accordance with claim 18 wherein:

said receiving means includes: a digital signal port connected to said microcontroller; and a display connected to said microcontroller.

21. A user management interface in accordance with claim 17 wherein:

said receiving means further includes: an infrared transceiver means connected to said microcontroller.

22. A user management interface in accordance with claim 17 wherein:

said receiving means includes: a video input port; and a video processor means coupled to said video input port and to said microcontroller.

23. A user management interface in accordance with claim 17 wherein:

said receiving means includes: a speaker/microphone unit coupled to said microcontroller.

24. A user management interface in accordance with claim 23 wherein:

said speaker/microphone unit comprises: audio processor means coupled to said microcontroller; a speaker connected to said audio processor; and a microphone connected to said audio processor.

25. In combination:

an electronic article surveillance ("EAS") system;

and a user management interface for interaction, monitoring and control of said EAS system, said user management interface comprising: user accessible input means for actuation by a user; generating means responsive to said user accessible input means for generating signals for interacting with said EAS system; and receiving means for receiving signals from said EAS system to provide indications with respect thereto, said signals received by said receiving means from said EAS system including signals indicative of EAS system event data.

26. The combination of claim 25 wherein:

said EAS system comprises: a central station including: means for storing EAS system event data; and a program driven central processing unit for controlling said EAS system, said central processing unit being responsive to one or more said signals generated by said generating means of said user management interface and enabling generation of one or more of said signals received by said receiving means of said user management interface.

27. The combination of claim 26 wherein:

said EAS system further includes: a local station having a microcontroller, said microcontroller communicating with said central processing unit of said central station and said user management interface and relaying signals therebetween.

28. The combination of claim 27 wherein:

said local station further includes: transmitter and receiver antenna assemblies for transmitting interrogation signals into and receiving signals from an interrogation zone; a motion sensor for sensing the people traffic through said interrogation zone;

said combination further includes a deactivation device for deactivating EAS tags;

and said motion sensor and deactivation device communicate with said microcontroller.

29. The combination of claim 28 wherein:

said interacting includes one or more of controlling the enabling and disabling of said EAS system.

30. The combination of claim 29 wherein:

said receiving means includes display means for displaying said EAS system event data and an indication of this type of data being displayed.

31. The combination of claim 30 wherein:

said EAS system event data includes one or more of the following: the number of alarm conditions of said EAS system; the number of people passing through said EAS system; the number of disablements of said EAS system; and the number of a times EAS tags in said EAS system have been deactivated.

32. The combination of claim 31 wherein:

said signals received by said receiving means from said EAS system further include signals indicative of the enabled and disabled states of one or more of an EAS tag deactivation device and the said EAS system;

and said receiving means includes further display means for displaying the enabled and disabled states of one or more of said tag deactivation device and said EAS system.

33. The combination of claim 25 wherein:

said generating means includes a microcontroller.

34. The combination of claim 33 wherein:

said generating means includes a keyboard means;

and said microcontroller is responsive to said keyboard means.

35. The combination of claim 34 wherein:

said keyboard means includes: a keyboard for entering requests to said microcontroller for EAS system status event data; and a keypad for supplying identification information to said microcontroller.

36. The combination of claim 34 wherein:

said receiving means includes: a digital signal port connected to said microcontroller; and a display connected to said microcontroller.

37. The combination of claim 33 wherein:

said receiving means further includes: an infrared transceiver means connected to said microcontroller.

38. The combination of claim 33 wherein:

said receiving means includes: a video input port; and a video processor means coupled to said video input port and to said microcontroller.

39. The combination of claim 33 wherein:

said receiving means includes: a speaker/microphone unit coupled to said microcontroller.

40. The combination of claim 39 wherein:

said speaker/microphone unit comprises: audio processor means coupled to said microcontroller; a speaker connected to said audio processor; and a microphone connected to said audio processor.

* * * * *

UNITED STATES PATENT AND TRADEMARK OFFICE

CERTIFICATE OF CORRECTION

PATENT NO. : 5,737,241

DATED : April 7, 1998

INVENTOR(S) : Accolla et al.

It is certified that error appears in the above-indentified patent and that said Letters Patent is hereby corrected as shown below:

Col. 3, line 67, delete "lid" and insert – 11D –.

Signed and Sealed this

Twenty-fifth Day of August, 1998

Bruce Lehman

*Attest:*

BRUCE LEHMAN

*Attesting Officer*

*Commissioner of Patents and Trademarks*